US005913412A

United States Patent [19]

Huber et al.

[11] Patent Number: 5,913,412

[45] Date of Patent: Jun. 22, 1999

[54] PROTECTIVE HELMET

[75] Inventors: Walter Huber, Bobingen; Andreas Hassler, Rohrdorf, both of Germany

[73] Assignee: SO Services AG, Steinhausen, Switzerland

[21] Appl. No.: 08/716,286

[22] PCT Filed: Mar. 21, 1995

[86] PCT No.: PCT/EP95/01056

§ 371 Date: Dec. 5, 1996

§ 102(e) Date: Dec. 5, 1996

[87] PCT Pub. No.: WO95/25446

PCT Pub. Date: Sep. 28, 1995

[30] Foreign Application Priority Data

Mar. 22, 1994 [DE] Germany ..... 44 09 839

[51] Int. Cl.[6] ..... A42B 3/12

[52] U.S. Cl. ..... 2/414; 2/413

[58] Field of Search ..... 2/413, 414, 410, 2/411, 425

[56] References Cited

U.S. PATENT DOCUMENTS

| | | | |
|---|---|---|---|
| 2,618,780 | 11/1952 | Cushman | 2/410 |
| 3,713,640 | 1/1973 | Margan | 2/413 |
| 3,761,959 | 10/1973 | Dunning | 2/413 |
| 3,829,900 | 8/1974 | Marangoni | 2/410 |
| 3,849,801 | 11/1974 | Holt et al. | 2/413 |
| 3,866,243 | 2/1975 | Morgan | 2/413 |
| 4,370,754 | 2/1983 | Donzis | 2/2 |
| 4,586,200 | 5/1986 | Poon | 2/413 |
| 5,259,071 | 11/1993 | Scott et al. | 2/413 |

FOREIGN PATENT DOCUMENTS

| | | |
|---|---|---|
| 336295 | 4/1977 | Austria . |
| 393238 | 9/1989 | European Pat. Off. . |
| A-0 393 238 | 9/1989 | European Pat. Off. . |
| 77 29 063 U | 12/1977 | Germany . |
| A-34-04 554 | 7/1984 | Germany . |
| 3530396 | 2/1987 | Germany . |
| A-35 30 396 | 2/1987 | Germany . |
| 1378494 | 12/1974 | United Kingdom . |
| A-1 378 494 | 12/1974 | United Kingdom . |
| 2134771 | 8/1984 | United Kingdom . |
| A-2 134 771 | 8/1984 | United Kingdom . |
| A-336 295 | 5/1977 | WIPO . |
| 90/04932 | 5/1990 | WIPO . |
| WO-A-90 04932 | 5/1990 | WIPO . |
| 93/01732 | 2/1993 | WIPO . |
| WO-A-93 01732 | 2/1993 | WIPO . |

*Primary Examiner*—Michael A. Neas
*Attorney, Agent, or Firm*—Darby & Darby

[57] ABSTRACT

Protective helmet (10), in particular for motorcyclists or the like, with an outer casing formed in particular as an outer shell (11) and a lining (12) which is accommodated in the outer casing and lines the latter at least in areas. At least in partial regions, the lining (12) comprises a cushion which can be evacuated of air, is divided into individual segments (13, 14, 15, 16) and is filled with resilient packing (38).

18 Claims, 2 Drawing Sheets

PROTECTIVE HELMET

BACKGROUND OF THE INVENTION

1. Field of the Invention

The invention at hand concerns a protective helmet, in particular for motorcyclists or the like, with an outer casing formed in particular as an outer shell and a lining which is accommodated in the outer casing and lines the latter at least in areas.

2. Discussion of the Related Art

Protective helmets of the aforementioned type are used in many, to some extent very diverse, areas and are used in both the area of work protection as well as in the leisure and sports area as a protective head covering. In this, the essential components of a protective helmet, namely the outer casing that is formed as an outer shell as a rule and the lining, are attributed particular functions that supplement one another regardless of the field of application. The outer shell is as a rule designed to be relatively resistant to bending and serves as an outer protective sheathing of the lining as well as for introducing the impact shocks to the lining as uniformly and planarly as possible. The lining itself essentially serves to absorb and reduce the impact energy before this reaches the head of the helmet wearer. In comparison to outer shells that are relatively resistant to bending, the shell lining, as a rule, is therefore designed to be relatively unresistant to bending and relatively elastic as well as cushioning.

Apart from the special material properties that the outer shell and the shell lining of a protective helmet have, the fit of the helmet on the head of the helmet wearer is decisive for the protective effect that can be achieved with a protective helmet. The best protective effect is achieved with a fit of the protective helmet or the lining that is as close as possible. The fit of a protective helmet that is as close as possible stands in direct contrast in known protective helmets to comfort of wear. Due to the varying skull geometries of helmet wearers, a close fit is frequently possible in the case of a helmet that is manufactured in a standard size only by corresponding tight stretching of the helmet's chin strap. It's true that in many areas close fitting contact is achieved between the shell lining and the head of the helmet wearer this way. This is achieved, however, at the price that, particularly in the case of longer wear of the protective helmet, uncomfortable pressure points become noticeable, or that the helmet wearer gets a headache as a result of the increased pressure. In addition to impairing the comfort of wear, in the case of motorcyclists, this has a negative effect on driving safety.

SUMMARY OF THE INVENTION

As a result, the invention at hand is based upon the object of creating a protective helmet with a lining that has the properties that so far have appeared to be incompatible as well as upon the object of making possible a close fit as well as high wear comfort.

The protective helmet in accordance with the invention is equipped with a lining that, at least in partial regions, has a cushion which can be evacuated of air, divided into individual cushion segments and is filled with resilient packing.

With the cushion in an aerated condition, the resilient packing bodies can easily be shifted against one another and, thus, permit the formation of a very soft cushion that can easily be altered in terms of its shape. With a cushion in this condition it is, therefore, particularly easy to stick a protective helmet that has been equipped with this kind of cushion lining over the head or to remove it. In doing so, the cushion or the cushion filling adapts particularly well to the individual skull geometry of the helmet wearer and, as a result, essentially fits uniformly with the cushion surface on the entire surface of the skull covered by the cushion. As a result of the subsequent evacuation of the cushion, the adapted cushion fit is quasi frozen, whereby, for one, a close fitting and indeed comfortable fit remains for the helmet wearer and, secondly, the deformability of the cushion is reduced to the resilient pliability of the packing because of the arrangement of the packing that is now close-fitting as a result of the evacuation. Therefore, in an evacuated condition the cushion shows evidence of good cushioning properties that are desired for absorbing impacts.

Since the soft and particularly easy to deform design of the cushion can be restored at any time by aerating the cushion, something which makes it possible to easily and almost weakly remove the protective helmet from the head of the helmet wearer, the protective helmet in accordance with the invention also fulfills to a special degree the requirement that exists in particular in the case of motorcyclists that it must be possible to easily remove the protective helmet after an accident, i.e., for instance in the case of unconsciousness.

Beyond this, however, the protective helmet in accordance with the invention offers a completely new possibility in manufacturing ready-to-wear protective helmets, since several ready-to-wear sizes can be covered with one and the same lining as a result of the easy adaptability of the helmet lining.

In a preferred embodiment the cushion segments individually or in a vacuum-tight combination form cushion units that each have an evacuation device. This advantageous embodiment makes possible an almost arbitrarily fine distribution of the lining in individual evacuation zones, which can then prove to be advantageous if a helmet shell being used as an outer casing is made of several parts. In this case, the individual evacuation zones can then be allocated to the individual shell components.

With a particularly preferred embodiment, the evacuation device is equipped with a valve attached to the outer casing and a vacuum pump that is allocated to this and attached outside on the outer casing and formed approximately as a suction bellows. This arrangement makes it possible for the helmet wearer to execute the evacuation or aeration of the cushion himself at any time in an especially advantageous manner without having to separately carry the devices required for this.

A further advantageous possibility of forming the evacuation device consists of equipping a reflux valve in a cushion wall and of equipping the cushion unit, which as designed above can be formed by an individual cushion segment or a combination of cushion segments, with a surface pressure device to deaerate the cushion unit via the reflux valve.

This formation of the evacuation device makes it possible, for example, to evacuate the cushion via a chin strap that is connected with a pressure support that is attached to the external cushion wall, so that evacuation and the associated dimensional stability of the cushion takes place when putting on and tightening the chin strap. Consequently in comparison to conventional protective helmets, no additional measures have to be carried out by the helmet wearer in order to evacuate the cushion.

The evacuation device can also be made of an at least partially air-porous cushion wall, which makes deaeration possible via the cushion wall with pressure from the outside, for example when the helmet is put on. As long as the pressure remains in existence, the deaerated condition of the cushion continues. After removal of the helmet, the cushion is then gradually aerated again.

Also proven to be advantageous are when the cushion has island areas or free spaces, preferably in the areas of the outer shell that cover the external ears of the helmet wearer. For one thing, particularly pressure-sensitive areas on the head of the helmet wearer are avoided by virtue of this arrangement. For another thing, the sound absorbing effect of the cushion from the free spaces or island areas remains without an effect on the ability of the helmet wearer to hear, so that this also makes a contribution to traffic safety.

It is particularly advantageous if the segments are divided off from one another via bridges that at least to some extent are formed by vacuum-tight adjacent areas of the cushion walls. In the case of cushion walls that are formed from thermoplastic material, these types of bridges can be made from torch cuts, for example. The bridges that are formed in this manner make separate devices to form the separations superfluous.

Connecting the cushion segments to one another can also take place via air-permeable intermediate areas in the bridges or also via air channels or air piping connections or via central air piping.

The cushion walls can be equipped with an external liner facing the helmet's outer shell and/or an inner liner facing the head of the helmet wearer, which can have different materials and/or material surfaces. This makes it possible to form the liners as functional layers that each have special properties corresponding to their arrangement.

Thus, the external liner can for instance be equipped with an adhesive coating that prevents undesired slipping of the outer shell of the helmet against the external liner. Depending upon the type of formation of the adhesive coating, this can even make separate connecting devices between the liner and the outer shell of the helmet superfluous.

It has also proved to be advantageous if the inner liner is formed as a climate system with at least two layers made of different materials. An outer layer that faces the head of the helmet wearer can be made of a synthetic material with air permeability and moisture permeability and an intermediate layer arranged between the outer layer and the lining can be made of an absorbent material such as fleece or a cotton layer.

It is especially advantageous, particularly with a formation as a climate system, if the inner liner is attached to the lining so that it can be replaced.

With respect to the protective helmet's comfort of wear, it has also proven to be especially agreeable if the bridges or the island areas of the cushion are equipped with ventilation openings that for one prevent an accumulation of heat in the head area and for another provide for a sufficient carrying-off of moisture.

Besides being equipped with cushion segments, the lining can be provided with elastic areas of padding, for instance in the area of the rear lower edge of the helmet, that can be made of air padding or even of padding inserts such as cellular inserts and are responsible for a further increase in the comfort of wear.

BRIEF DESCRIPTION OF THE DRAWINGS

In the following, a preferred embodiment of a protective helmet in accordance with the invention will be explained in more detail on the basis of the drawings. They show the following.

DETAILED DESCRIPTION OF A PREFERRED EMBODIMENT

Figure 1:
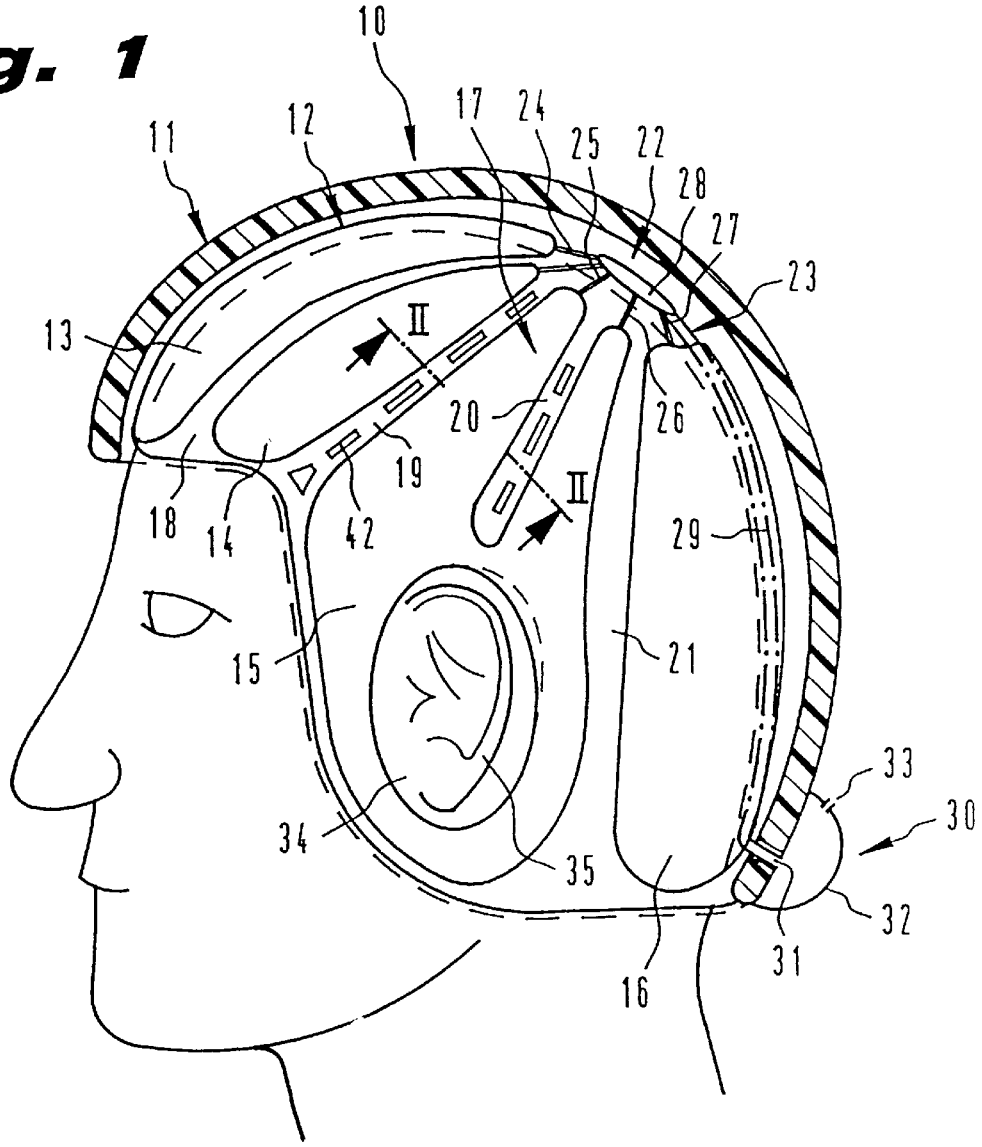
FIG. 1 A protective helmet shown with a sectional helmet shell and the lining that is accommodated in it.
Figure 3:
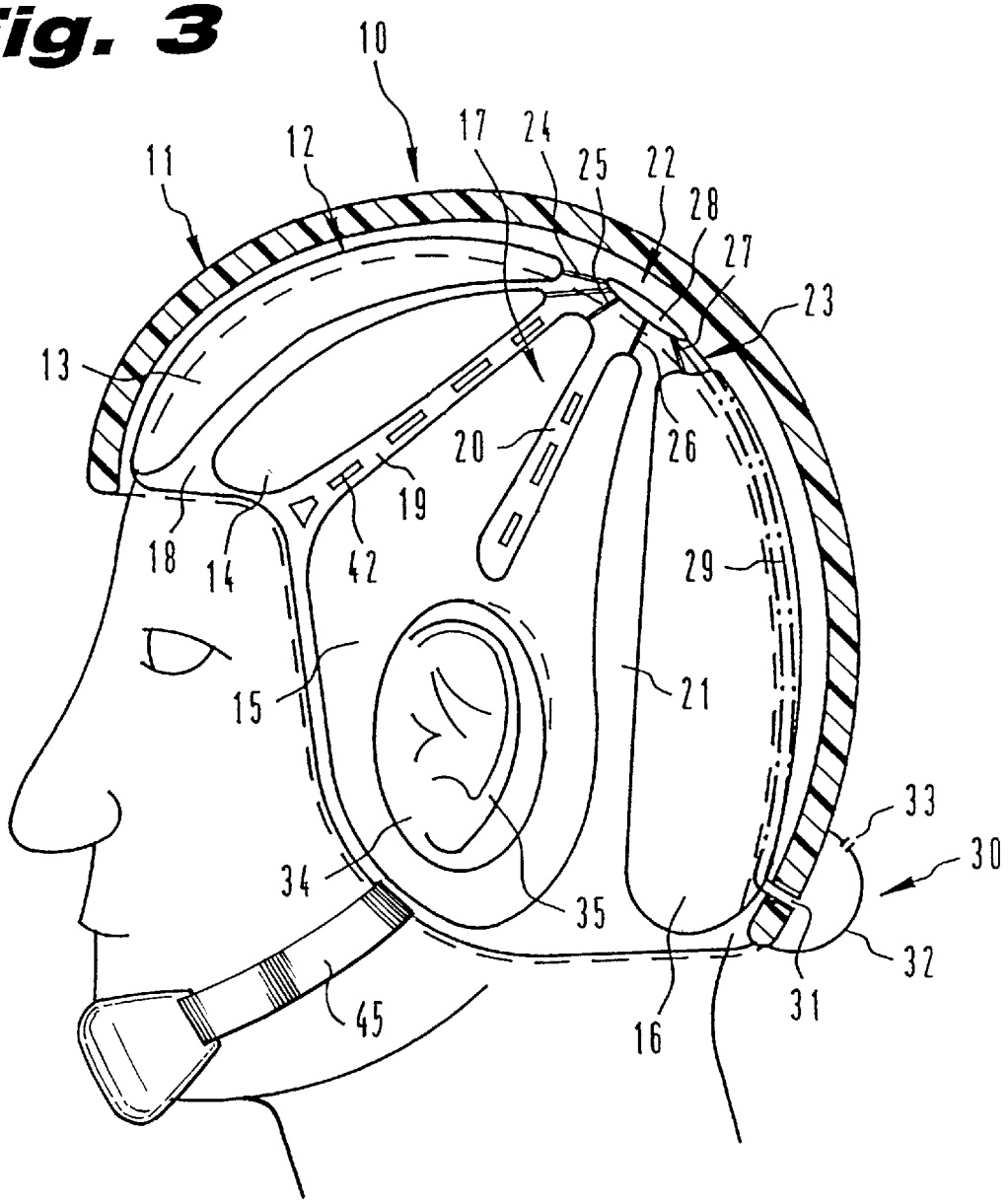
FIG. 3 Another illustration of the protective helmet of the invention.

FIGS. 1 and 3 show a protective helmet 10 (having a chin strap 45) that is represented with a sectional helmet outer shell 11 and is on the head of the helmet wearer for the purposes of better explanation. In the embodiment of the protective helmet that is shown here, one is dealing with a jet helmet for motorcyclists. This helmet could just as well have been designed as semi-shell helmet or integral helmet. Lighter embodiments, like those that are used by bicyclists for instance, are also conceivable particularly with respect to the formation of the helmet outer shell.

Regardless of the development of the helmet outer shell 11, a lining 12 is provided in any case, which in this embodiment is formed as a whole as a coherent vacuum cushion with individual cushion segments, of which only cushion segments 13, 14, 15 and 16 are visible due to the representation of the protective helmet 10 in FIG. 1 in side view. Additional correspondingly arranged cushion segments are arranged on the opposite side of the head that is not shown here.

The individual cushion segments 13, 14, 15 and 16 are divided off from one another via bridges 18, 19, 20, 21 in a vacuum-tight manner and together form a cushion unit with a common evacuation device that has a reflux valve 31 and a suction bellows 32.

In the case of the embodiment that is described here, the bridges 18, 19, 20, 21 are formed surrounding the cushion segments 13, 14, 15, 16. It is also just as well possible that the bridges only represent separations in certain areas between the individual cushion segments in areas and in remaining areas the segments are formed by merging into one another.

With the lining that is depicted here, the cushion segments are arranged radiated on the head of the helmet wearer and run together in a skull area 22. In the skull area 22 there is a tonsure-shaped free space 23 in the lining 12 into which air pipings 24, 25, 26, 27 are attached that originate from the skull-side end regions of the cushion segments 13, 14, 15 and 16 and terminate in a common connection piece 28. Issuing from the connection piece 28, a collection line 29 runs between the two cushion segments that are arranged on the rear head of the helmet wearer, of which only the one cushion segment 16 is shown in the view depicted in FIG. 1, and terminates in the reflux valve 31 attached in the area of a rear helmet lower edge 30 in the helmet outer shell 11. The suction bellows 32 is provided with a deaeration opening 33 outside on the helmet outer shell 11 overlapping the reflux valve 31. The reflux valve 31 that is not depicted here in detail is equipped with an aeration device, also not shown here, for aearating the cushion segments 13, 14, 15 and 16.

For aeration purposes, the bridges 18, 19, 20 and 21 are provided with perforations 42, either in partial regions or completely, that permit a exchange of air between the outside environment and the head surface. The tonsure-shaped free space 23 in the skull area 22 also contributes to this.

In the case of the embodiment shown here, cushion segment 15 is provided with an additional free space 34 that serves to accommodate an external ear 35. Instead of a free space, an island area of the cushion segment 15 that is not shown here in detail can be provided in the area of the external ear that, similar to a bridge, is formed from adjacent areas of cushion walls 36, 37 (FIG. 2) and can be provided with perforations, however, deviating from this, has a planar distension that covers the area of the external ear.

Figure 2:
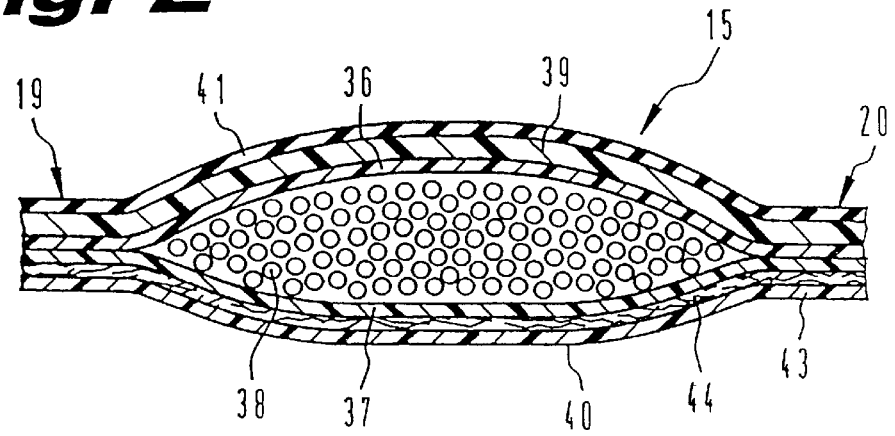
FIG. 2 A broken-out representation of the lining that is formed as a vacuum cushion.

FIG. 2 shows a cross-sectional representation of the cushion segment 15 in an area between the bridges 19 and 20. The structure of the lining 12 as a whole becomes clears from this depiction. The lining 12 has two cushion walls, the outer cushion wall 36 and the inner cushion wall 37 that are connected by bridges 19, 20 to form the cushion segments, of which only cushion segment 15 is shown here as an example, which bridges are formed here by bonding in areas or heat sealing in areas of the cushion walls 36 and 37 with one another. Cushion segment 15 as well as the other cushion segments are filled with resilient packing 38 that can freely move against one another in an aerated condition of the cushion segment 15, thereby creating a soft and less elastic formation of the cushion segment.

Functional liners 39 and 40 are attached outside on the cushion walls 36 and 37 that are formed here from a thermoplastic synthetic. The outer functional liner 39 consists of a wear-resistant material that has a rubber adhesive coating 41 on the outside and consequently provides for a good hold of the lining 12 in the helmet outer shell 11. The inner functional liner 40 as a climate system is provided with an outer synthetic layer 43 and an absorbent intermediate layer 44 made of fleece and is consequently responsible for the helmet wearer having an agreeable feel during wear.

As already mentioned above, the individual cushion segments of the lining 12 are in an aerated state in the initial condition, i.e., when putting the protective helmet 10 on, so that the protective helmet 10 can be placed simply on the head of the helmet wearer without great resistance. If the protective helmet 10 is in a comfortable fit position for the helmet wearer, the cushion segments of the lining 12 are deaerated by repeated pressing of the suction bellows 32, whereby the inner functional liner 40 adapts in a close fit in terms of its contour to the skull contour of the helmet wearer. Due to the resulting large-surface contact areas between the lining 12 and the head of the helmet wearer, a relatively low pressure of the lining on the head of the helmet wearer is already sufficient into order to guarantee an exact, essentially immobile fit of the protective helmet 10 on the head.

Due to the deaearted state of the individual cushion segments, from now on the packing bodies 38 fit close together and are no longer movable relative to one another. By virtue of this, the previously soft, inelastic formation of the lining 12 is replaced by a relatively inflexible, elastically cushioning formation, whereby the elastically cushioning properties are essentially prescribed by the material properties of the packing 38. In the case of the embodiment described here, the packing 38 is made of Styrofoam balls; but can also be made of other suitable, elastics synthetics.

In order to remove the protective helmet 10, the cushion segments of the lining 12 are aerated by actuating the aeration device, so that the soft, pliable formation of the lining 12 is restored and the protective helmet can be removed more easily.

With the protective helmet illustrated in FIG. 1, the outer casing is formed by a relatively rigidly formed outer shell. It is conceivable, however, that this type of outer shell be dispensed with so that in particularly light embodiments of the protective helmet, the outer casing can also be formed by the wear-resistant outer functional liner 39.

We claim:

1. A protective helmet with an outer casing formed as an outer shell and a lining which is accommodated in the outer casing and lines the latter at least in areas, said lining, in at least one region, comprises a cushion which is divided into individual cushion segments, said cushion segments being filled with resilient shiftable packing bodies, said cushion segments being evacuatable of air by evacuation means to transfer said cushion segments from an aerated state to a deaerated state;

and wherein in said deaerated state, said resilient packing bodies being in close-fit connection to one another, the close-fit connection being maintained by said evacuation means maintaining a deaerated state.

2. The protective helmet in accordance with claim 1, wherein the evacuation means is formed of an least partially air-porous cushion wall, which when there is pressurization from the outside any air present in the cushion is pressed to the outside.

3. The protective helmet in accordance with claim 1, wherein the evacuation means has a reflux valve provided in a cushion wall and the cushion is equipped with a surface pressure device to deaerate the cushion via the reflux valve.

4. The protective helmet in accordance with claim 1, wherein the lining has island areas that cover the external ears of the helmet wearer.

5. The protective helmet in accordance with claim 4, wherein the cushion segments are divided off from one another via bridges that at least to some extent are formed by vacuum-tight adjacent areas of the cushion walls.

6. The protective helmet in accordance with claim 5, wherein at least one of the bridges and the island areas of the lining are equipped with ventilation openings.

7. The protective helmet in accordance with claim 1, further comprising an outer functional liner facing the helmet's outer shell and an inner functional liner of the lining facing the head of the helmet wearer.

8. The protective helmet in accordance with claim 7, wherein the outer functional liner has an adhesive coating.

9. The protective helmet in accordance with claim 7, wherein the inner functional liner comprises at least two layers of different materials to form a climate system.

10. The protective helmet in accordance with claim 1, wherein the lining has elastic areas of padding.

11. The protective helmet in accordance with claim 4, wherein the island areas are disposed in the area of said outer shell.

12. The protective helmet in accordance with claim 7, wherein said outer shell and said inner functional liner are formed from materials having different characteristics.

13. The protective helmet in accordance with claim 9, wherein said inner functional liner includes an outer layer of synthetic material facing the head of the helmet wearer, said outer layer being air permeable and moister permeable and an intermediate layer provided between the outer layer and the lining, said intermediate layer being made of an absorbent material.

14. The protective helmet in accordance with claim 13, wherein said intermediate layer is made of fleece.

15. The protective helmet in accordance with claim 10, wherein said padding is air padding.

16. The protective helmet in accordance with claim 10, wherein said padding is cellular padding.

17. A protective helmet with an outer casing formed as an outer shell and a lining which is accommodated in the outer casing and lines the latter at least in areas, said lining, in at least one region, comprises a cushion which is divided into individual cushion segments, said cushion segments being filled with shiftable resilient packing bodies, said cushion segments being evacuatable of air by an evacuation device to transfer said cushion segments from an aerated state to a deaerated state;

wherein in said deaerated state, said resilient packing bodies being in close-fit connection to one another; and wherein the evacuation device has a reflux valve that is connectable to a vacuum pump that is attached externally to the outer shell.

18. The protective helmet in accordance with claim 17, wherein said reflux valve is attached to said outer shell.

* * * * *

UNITED STATES PATENT AND TRADEMARK OFFICE

CERTIFICATE OF CORRECTION

PATENT NO. : 5,913,412
DATED : June 22, 1999
INVENTOR(S) : Huber et al

It is certified that error appears in the above-identified patent and that said Letters Patent is hereby corrected as shown below:

On the cover page of the patent:
change "[73] Assignee: So Services AG, Steinhausen, Switzerland,"
to: --[73] Assignee: Andreas Hassler, Rohrodorf, Germany (part interest)--

Signed and Sealed this

Eleventh Day of January, 2000

*Attest:*

*Attesting Officer*

Q. TODD DICKINSON

*Acting Commissioner of Patents and Trademarks*